United States Patent [19]

Masuda et al.

[11] Patent Number: 4,689,983

[45] Date of Patent: Sep. 1, 1987

[54] METHOD FOR PRODUCING WORM SHAFT FOR USE IN POWER STEERING APPARATUS

[75] Inventors: Naosuke Masuda; Sohsuke Sunaga, both of Saitama, Japan

[73] Assignee: Jidosha Kiki Co., Ltd., Tokyo, Japan

[21] Appl. No.: 571,171

[22] Filed: Jan. 16, 1984

[30] Foreign Application Priority Data

Jan. 14, 1983 [JP] Japan ..... 58-4787

[51] Int. Cl.[4] ..... B21D 22/26; B21D 22/28

[52] U.S. Cl. ..... 72/356; 72/358; 72/377

[58] Field of Search ..... 72/356, 358, 377, 360

[56] References Cited

U.S. PATENT DOCUMENTS

| | | | |
|---|---|---|---|
| 2,586,336 | 2/1951 | Huck | 72/354 |
| 3,921,669 | 11/1975 | Goff | 137/625.24 |
| 4,050,283 | 9/1977 | Schober | 72/760 |
| 4,291,568 | 9/1981 | Stifano | 72/316 |

FOREIGN PATENT DOCUMENTS

| | | |
|---|---|---|
| 2178 | 2/1970 | Japan . |
| 49726 | 5/1978 | Japan . |
| 119565 | 3/1979 | Japan . |
| 167872 | 10/1980 | Japan . |

*Primary Examiner*—Robert L. Spruill
*Assistant Examiner*—David B. Jones
*Attorney, Agent, or Firm*—Sughrue, Mion, Zinn, Macpeak, and Seas

[57] ABSTRACT

A method for producing a worm shaft for use in a rotation control valve of a power steering mechanism. The worm shaft is formed with grooves which receive a control body and form therewith a fail safe structure. The grooves are formed evenly so that the permitted range of movement on either side of a neutral position is uniform. A cylindrical member is plastically deformed in two steps to form the outer side of the control valve. Then, while in a die having in inner shape corresponding to the desired outer shape of the worm shaft, a punch, having an outer shape corresponding to the desired shape of the grooves on the inner surface of the worm shaft and an enlarged-diameter portion, is pressed into a hole in the interior of one end of the member to thereby plastically deform the member to the desired final inner and outer configurations.

3 Claims, 5 Drawing Figures

METHOD FOR PRODUCING WORM SHAFT FOR USE IN POWER STEERING APPARATUS

BACKGROUND OF THE INVENTION

The present invention relates to a method for producing a worm shaft for use in a power steering apparatus provided with a rotation control valve.

In a power steering apparatus of this type, a rotation control valve is constituted by a valve rotor, which rotates together with an input shaft, and a valve sleeve, which is integrated with a worm shaft connected to the input shaft through a torsion bar. The rotation control valve controls, via fluid control passages formed therein and in the inner surface of an enlarged-diameter portion of the valve sleeve, the distribution of pressurized fluid to a piston threadedly engaged with the worm shaft to thereby provide steering power to an output shaft engaged with the piston. In the rotation control valve, the valve rotor and the valve sleeve are maintained in the neutral state during nonoperational periods by the torque of the torsion bar, and relative rotation of the valve rotor and the valve sleeve is restricted such that the input shaft and the worm shaft can rotate relatively to one another within a predetermined angular range defined by a fail safe structure formed therebetween. More specifically, interleaved grooves which allow relative rotation between the input shaft and the worm shaft are formed in the outer periphery of the input shaft and the inner periphery of the worm shaft, which structure is hereinafter referred to as a fail safe structure, thereby making possible relative rotation in the amount allowed by the gap between the grooves but making it possible to steer the vehicle if the power steering hydraulic system fails.

In the conventional worm shaft, the grooves of the fail safe structure and the fluid control passage are separately machined. It may happen that the neutral position of the valve sleeve and valve rotor does not occur at a point where equal spaces are present on either side of each of the grooves of the fail safe structure due to a misalignment between the grooves and the fluid control passages. Such a power steering apparatus has a defect that a deterioration in strength due to metal fatigue may occur because excessive torque is applied to the torsion bar during rotation in one of the two directions for which the amount of possible movement is greater. There is a further disadvantage that the manufacture of this product is expensive because two steps are required, one for forming the grooves of the fail safe structure and the other for forming the fluid control passages.

SUMMARY OF THE INVENTION

The present invention has been attained in view of the above-mentioned drawbacks. Taking the above into account, the invention provides a method for producing a worm shaft for use in a power steering apparatus in which a valve sleeve, associated with a rotation control valve for controlling the supply/discharge of pressurized fluid, and a fail safe structure are formed at one end portion of the worm shaft. In accordance with the invention, the grooves of the fail safe structure and the fluid control passages are formed in a single step in such a manner as to prevent misalignment therebetween.

DESCRIPTION OF THE PREFERRED EMBODIMENTS

Figure 1:
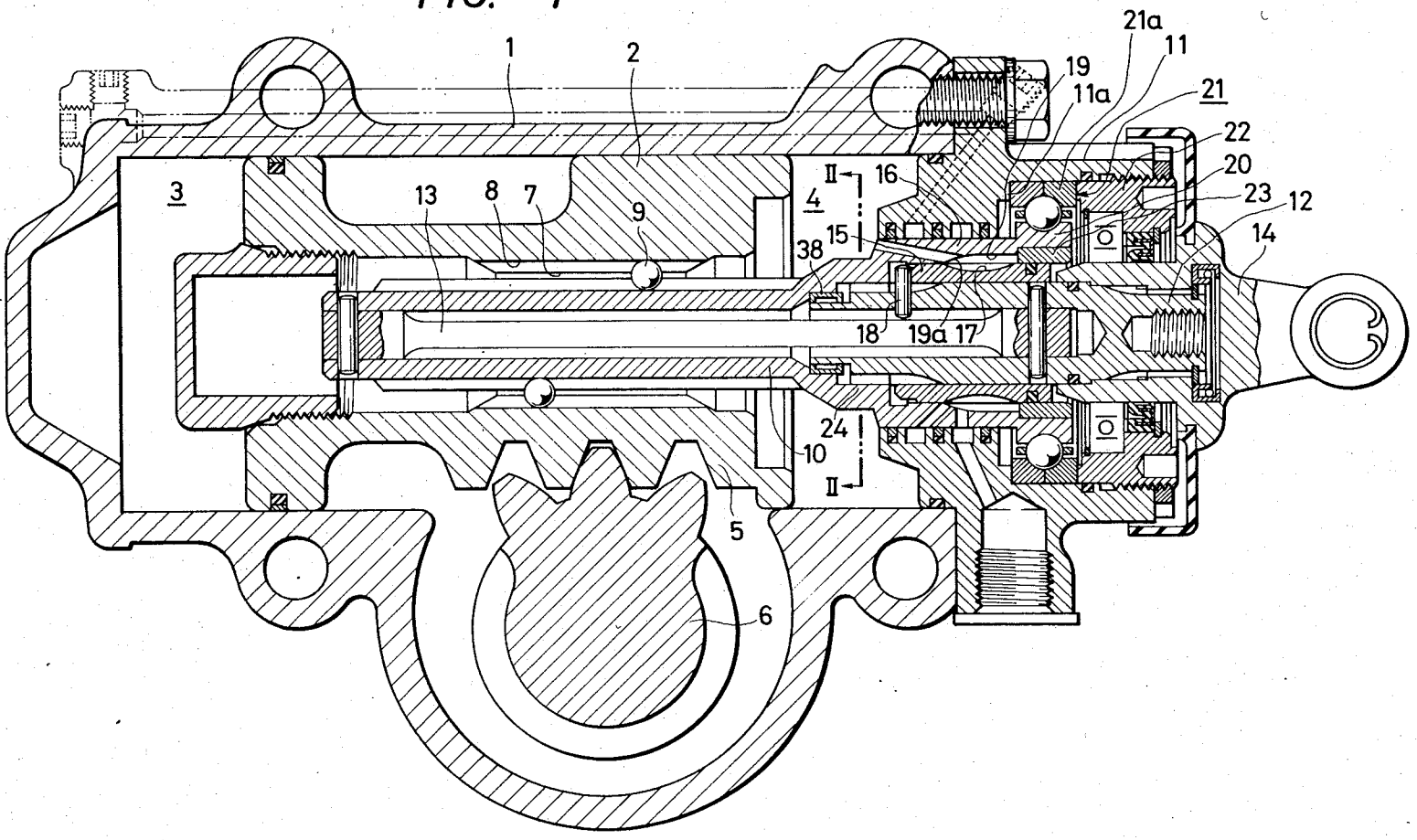
FIG. 1 a cross-sectional view of a power steering apparatus using a worm shaft produced by a method in accordance with the present invention.

The present invention will now be described hereinafter on the basis of a preferred embodiment shown in the drawings. FIG. 1 shows a power steering apparatus provided with a worm shaft produced by the method of the present invention. A piston 2 is slidably fitted in a housing 1. The inside of the housing is partitioned by the piston 2 into a front actuator chamber 3 and a rear actuator chamber 4. A rack 5 is formed on the bottom surface of the piston 2 and a sector wheel 6 interlocked with a steering wheel (not shown) is engaged with the rack 5 so that the sector gear 6 rotates clockwise/counterclockwise as the piston 2 reciprocates.

A female screw thread 8 is formed in a hole 7 at the axially central portion of the piston 2, and a worm shaft 10 is screwed into the groove 8 through a number of balls 9 disposed in the groove 8. An input shaft 12 is provided in axial alignment with the worm shaft 10 in a valve housing 11 fixed to the steering body 1. The shafts 10 and 12 are coupled together by a torsion bar 13 inserted into the respective central axial portions of the shafts 10 and 12. Further, the input shaft 12 is interlocked with a steering wheel (not shown) through a yoke 14.

The rotation control valve received in the valve housing 11 is constituted by a valve rotor 15 and a valve sleeve 16, the latter constituting an integral part of the worm shaft 10. The valve rotor 15 comprises a cylindrical member and is provided at its outer periphery with a plurality of equidistantly separated and axially extending circular grooves 17. The rotor 15 is coupled to the input shaft 12 by a pin 18, whereby the valve rotor 15 rotates integrally with the input shaft 12. The valve sleeve 16, provided with fluid control passage 19 corresponding to the passages 17 in the valve rotor 15, is formed in the worm shaft 10 at its large diameter portion on the side toward the input shaft 12 and is rotatably fitted over the outer periphery of the valve rotor 15. The worm shaft 10 has, at its opening end portion, an enlarged-diameter portion 20, which has larger inner and outer diameters than the large-diameter portion 16. The outer periphery of the large-diameter portion 16 constitutes the inner race of a bearing 21 which rotatably supports the worm shaft with respect to the housing 11. The outer race of the bearing 21 is sandwiched between a shoulder **11*a* of the housing 11 and a plug 22. The fluid control passages 19 of the valve sleeve 16 are formed with a depth which gradually decreases in an axial direction away from the opening portion thereof (leftward in FIG. 1). A sealing ring 23 is fitted at the inner periphery of the enlarged-diameter portion 20 with which the opening portion side of the groove 19** is sealed.

In the rotation control valve constituted by the valve rotor 15 and the valve sleeve 16 arranged as described above, a pressure difference is generated between the front and rear actuator chambers 3 and 4. The piston 2 is actuated by this pressure difference to provide an auxiliary force in the steering direction in the conventional manner. The forward end of the input shaft 12 is supported by a bearing 38 on the inside of the worm shaft 10.

Figure 2:
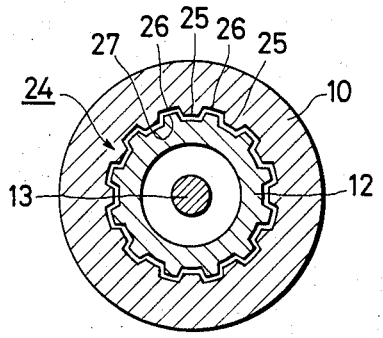
FIG. 2 is a cross-sectional view taken along a line II—II in FIG. 1.

A fail safe structure 24, which allows relative rotation between the valve rotor 15 and the valve sleeve 16 only through a predetermined angle while restricting further rotation, is provided between the outer periphery of the input shaft 12 near the forward end thereof and the inner periphery of the worm shaft 10 at a portion corresponding to the above-mentioned portion of the input shaft (FIG. 2). More specifically, axially extending ribs 25 are formed in the inner periphery of the worm shaft 10 while ribs 27, which engage with slots 26 between the respective protrusions 25 while allowing a fixed amount of relative rotation, are formed on the outer periphery of the input shaft 12. With this arrangement, the input shaft 12 and the worm shaft 10 are able to relatively rotate by an amount determined by the size of the slots 26.

Figure 3A:
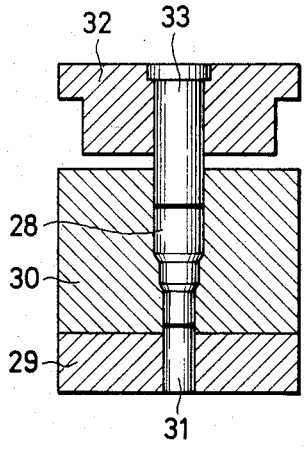
FIGS. 3A through 3C are explanatory diagrams illustrating an embodiment of the method of the present invention.
Figure 3B:
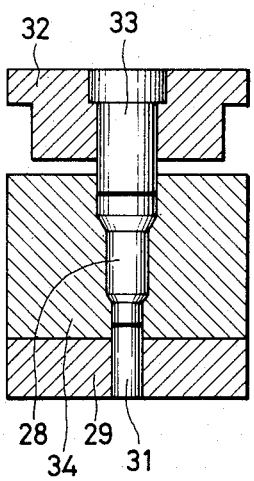
Figure 3C:
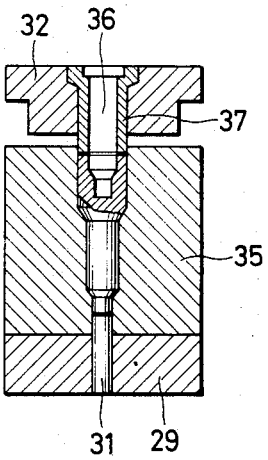

A method for producing a worm shaft having a structure as described above will now be explained. FIGS. 3A through 3C show successive steps in the production of the worm shaft 10. A cylindrical rod-like member 28 cut to a predetermined length is disposed in a die 30 attached to a die holder 29 and supported at its bottom by a knockout punch 31. A punch 33, attached to a punch holder 32, is provided above the die 30 in opposition to the die 30. The punch 33 is pressed against the member 28 to deform the outer shape thereof to approximate the outer shape of the worm shaft 10 (FIG. 3A). Next, the outer shape of the member 28 is made to more closely approximate the final outer shape of the worm shaft 10 in a second step employing a die 34 having a recessed portion of a shape more closely approximate to the final outer shape of the worm shaft 10 (FIG. 3B). Then, the outer surface of the worm shaft 10 is formed into the final shape, while simultaneously there are formed in a third step (FIG. 3C) the fluid control passages 19 (FIG. 1) in the inner periphery, ribs/slots 25 and 26 and the inner peripheral portion of the enlarged-diameter portion 20 to which the sealing ring 23 is fitted using a die 35 having a recess of substantially the same shape as the desired outer shape of the worm shaft 10, a punch 36 having an outer shape substantially the same as the desired shape of the inner surface described above, and a supporting member 37 attached to the periphery of the punch 36 for supporting the cylindrical opening end of the worm shaft 10 while it is being deformed. Since the various portions of the inner surface of the worm shaft 10 are shaped such that the inner diameter increases gradually toward the opening portion (rightwardly in FIG. 1), they can be formed at the same time through plastic working such as forging.

Since the passages 19 and the protrusions/slots 25 and 26 of the fail safe structure 24 of the worm shaft 10 are simultaneously formed in this manner, the number of manufacturing steps is reduced, thus decreasing the cost of the shaft. Moreover, a decrease in strength due to fatigue is prevented in a shaft produced according to the invention because there is no possibility for the amounts of possible movement, clockwise and counterclockwise, in the fail safe structure to be different, thereby preventing excessive torque in the torsion bar 10.

Further, a conventional power steering rotation control valve is provided with chamfers in the passages 17 of the valve rotor 15 in order to obtain an optimum steering characteristic. Such chamfers may be formed, alternatively, in the passage 19 of the sleeve 16 to obtain the same characteristics. Also in this case, applying the present invention, the chamfers can be simultaneously formed, thereby making it possible to further simplify the steps in production.

We claim:

1. In a method for producing a worm shaft for use in a power steering apparatus, said worm shaft having first and second end portions, said power steering apparatus comprising an input shaft, a rotation control valve including said worm shaft and a valve rotor fitted in a valve sleeve formed at said first end portion of said worm shaft, said method including the steps of forming said valve sleeve, forming fluid control passages on an inner peripheral portion of said valve sleeve, and forming a plurality of parallel ribs on an inner peripheral portion of said worm shaft toward said second end portion thereof, said ribs being physically separate from said fluid control passages, with a predetermined gap formed radially between said ribs for permitting a predetermined amount of relative rotation between said worm shaft and said input shaft, the improvement comprising the step of aligning said ribs and said fluid control passages by simultaneously forming said ribs and said fluid control passages by plastic working.

2. The method for producing a worm shaft of claim 1, wherein said method comprises the steps of: providing a generally cylindrically shaped member cut to a predetermined length; disposing said cylindrically shaped member in a first die attached to a die holder, said first die having an inner shape approximately that of a desired outer shape of the completed worm shaft; pressing a first punch against said member to deform said member to have an outer shape determined by said shape of said first die; disposing said member so formed in a second die having an inner shape more closely approximate to said desired outer shape of said worm shaft than said first die; pressing a second punch against said member to deform said member to said shape of said second die; disposing said member so formed in a third die having a recess therein of substantially the same shape as said desired outer shape of said worm shaft; pushing a third punch having an outer shape substantially the same as a desired shape of an inner surface of said worm shaft into an interior portion of said member to plastically deform said member and thereby form said ribs and said fluid control passages.

3. The improved method for producing a worm shaft of claim 2, wherein said valve sleeve is provided with an annular groove on an inner surface thereof adapted for receiving a sealing ring.

* * * * *